US006296033B1

(12) United States Patent
Clements

(10) Patent No.: US 6,296,033 B1
(45) Date of Patent: Oct. 2, 2001

(54) BLADE PROTECTOR FOR TAPE APPLICATORS AND DISPENSERS

(75) Inventor: Alan Clements, Tappan, NY (US)

(73) Assignees: Clements Industries, Inc.; Ben Clements & Sons, Inc., both of South Hackensack, NJ (US)

( * ) Notice: Subject to any disclaimer, the term of this patent is extended or adjusted under 35 U.S.C. 154(b) by 0 days.

(21) Appl. No.: 09/359,823

(22) Filed: Jul. 23, 1999

Related U.S. Application Data

(63) Continuation-in-part of application No. 09/304,656, filed on May 4, 1999, now abandoned.

(51) Int. Cl.[7] ..... B32B 31/00

(52) U.S. Cl. ..... 156/527; 156/579; 225/19; 225/20; 225/56; 225/77; 225/91

(58) Field of Search ..... 156/523, 579, 156/527; 225/19, 20, 91, 77, 56

(56) References Cited

U.S. PATENT DOCUMENTS

| | | | | |
|---|---|---|---|---|
| 3,186,892 | | 6/1965 | Walthers | 75/348 |
| 4,352,710 | | 10/1982 | Makley | 156/384 |
| 4,486,263 | | 12/1984 | Gomez | 156/523 |
| 4,818,329 | | 4/1989 | Tutas et al. | 156/391 |
| 4,857,134 | | 8/1989 | Lin | 156/385 |
| 5,067,222 | * | 11/1991 | Frank et al. | 29/411 |
| 5,197,386 | | 3/1993 | Lin | 101/213 |
| 5,236,540 | | 8/1993 | Shi | 156/523 |
| 5,288,362 | | 2/1994 | Lin | 156/523 |
| 5,393,367 | | 2/1995 | Chen | 156/523 |
| 5,456,790 | * | 10/1995 | Chen | 156/527 |
| 5,641,377 | * | 6/1997 | Chung et al. | 156/577 |
| 5,849,144 | | 12/1998 | Tang et al. | 156/523 |
| 6,039,102 | * | 3/2000 | Sadrakula et al. | 156/510 |

* cited by examiner

*Primary Examiner*—Linda Gray
(74) *Attorney, Agent, or Firm*—Stroock & Stroock & Lavan LLP

(57) ABSTRACT

A tape applicator includes a frame. A blade is affixed to the frame. A guard is mounted on the frame and extends from the frame beyond the edge of the blade. The guard is deflected as the tape is drawn across the blade.

28 Claims, 3 Drawing Sheets

BLADE PROTECTOR FOR TAPE APPLICATORS AND DISPENSERS

CROSS REFERENCE TO RELATED APPLICATION

This is a Continuation-in-Part Application of U.S. patent application Ser. No. 09/304,656 filed May 4, 1999, now abandoned.

BACKGROUND OF THE INVENTION

The present invention relates to tape applicators and/or dispensers (collectively "applicators"), and more specifically, to a guard for preventing accidental injury from the cutting edge of the applicator blade.

Adhesive tape applicators are known in the art for applying a tape to a surface such as a carton or the like and can be hand held or be suitable for resting on a table. The hand-held applicators are particularly suited for applying a long length of tape to the object to be taped. Generally, the applicator consists of a handle supporting a tape spool and device to guide and dispense the tape. A frame is supported on the handle, and a cutting blade comprising a sharply serrated edge is mounted on the frame along a tape feed path. The serrated edge has teeth which project beyond an edge of the tape applicator frame. However, by design, it often occurs that the blade protrudes too far from the frame. As a result, the blade may cut or injure a user or the blade itself may be damaged through simple handling of the manual applicator as the blade bangs against some hard object. However, if the blade were not to extend fully from the applicator, the ability to cut the tape when desired as it passes through the applicator would be hampered.

To overcome these shortcomings, a retractable blade was developed to be mounted in the frame as known from U.S. Pat. No. 5,849,144. In this embodiment, the blade is specially mounted within the frame utilizing a complex screw and shield mechanism in which the blade is operatively connected to a manual tape applicator wiper so that when the wiper is pressed to wipe the tape against the surface being taped, it pushes the blade against the bias of a spring to extend from the frame to cut the tape.

Such a mechanism has been satisfactory. However, it suffers from a disadvantage that it requires a complex spring and lever mechanism to protect the blade from injurious contact to the user or injury or to the blade itself Furthermore, because the blade is activated by the wiper which extends at an angle from the top of the frame, over rotation of the handle of the applicator is required to cause the blade to extend sufficiently to cut which strains the wrist as a result of repeated use of such an applicator. Additionally, to extract a small piece of tape by hand is a complex movement as one hand holds the handle, the other hand pulls and rips the tape, while the wiper must be activated. Furthermore, conventional applicators are limited to serrated blades, because the use of an exposed knife blade or razor is considered too dangerous for the user.

A second structure for protecting the blade from injurious contact with the user or with some hard object is known from U.S. Pat. No. 4,818,329 which provides for a manually operable tape dispenser/applicator having a frame and a blade extending from the frame. A guard is mounted on a rotatable shaft within the frame and extends beyond the blade. A spring is mounted within the frame to bias the guard towards the blade. The guard also wipes the tape as it is applied to the surface. This applicator is less than satisfactory because it suffers from the disadvantage that it too requires a complex structure including shafts and biasing springs anchored well within the housing and cannot be retroactively fit into a standard applicator. It too utilizes a serrated blade.

With respect to the table-top models of tape applicators, much like the conventional scotch tape dispensers, they have a base, with a roll of tape mounted therein. As is known in the art, a blade is usually mounted on the base along a travel path of tape as it leaves the roller and extends above the frame to be exposed for cutting tape. Because of the exposed blade, it lends itself to accidental scraping or cutting of the user's hand as the user's hand slides across the blade. This problem becomes even more pronounced in industrial tape applicators where the blade is sturdier and longer, supplying more of a cutting surface lending itself to deeper cuts and larger cuts. Furthermore, because the blade is bigger, it is in effect more exposed.

Accordingly, it is desired to provide a tape applicator which provides protection for the blade in both a hand held or table top applicator which may be retroactively added to the applicator and is of simple construction.

SUMMARY OF THE INVENTION

A tape applicator includes a handle having a frame supported by the handle. A blade is affixed to the frame and extends outwardly from the frame. A blade cover formed from a pliable material is affixed to the blade and extends from the frame beyond the front of the blade. A tape roll support for rotationally supporting a role of tape is supported by the frame.

Accordingly, it is an object of the present invention to provide an improved tape applicator.

Another object of the invention is to provide a hand-held and/or table top tape applicator which protects a user from the blade and the blade from injury and which is of simple construction.

Yet another object of the invention is to provide a hand-held applicator with blade guard which is less costly to manufacture.

A further object of the invention is to provide a hand held applicator in which the user is protected from the blade yet over rotation of the applicator is not required to expose the blade for cutting.

Still other objects of the invention will, in part, be obvious and will, in part, be apparent from the specification.

The invention accordingly comprises features of construction, combination of elements, and arrangement of parts which will be exemplified in the construction hereinafter and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
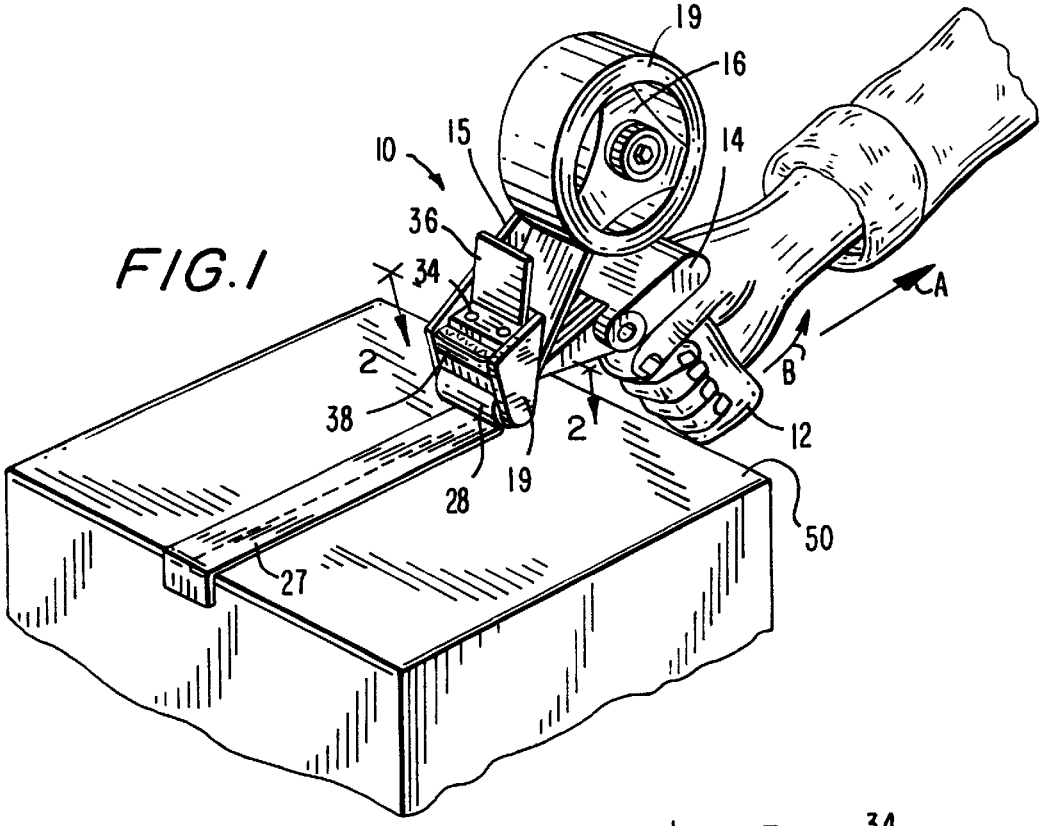
FIG. 1 is a perspective view of a tape applicator constructed and used in accordance with the invention.
Figure 2:
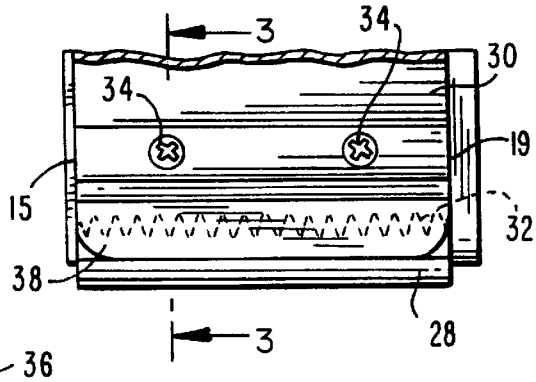
FIG. 2 is a sectional view taken along line 2—2 of FIG. 1.

Reference is now made to FIGS. 1 and 2 in which an exploded view of a handheld applicator generally indicated as 10, is provided. Applicator 10 has a handle 12 and a frame 14 mounted on and above handle 12. Frame 14 includes a first side member 15 and a side plate 19. Side plate 19 is affixed to side plate 15 by a connection plate 21. A shaft 16 is rotatably mounted on frame 14. An adapter 18 is mounted about shaft 16 and rotates about shaft 16 while supporting a role of tape 19 thereon. Adapter 18 is held in place on shaft 16 by a nut 20.

A gate 22 is mounted on frame 14. An engagement roller 28 is rotatably mounted within frame 14. Engagement roller 28 is rotatably mounted on shaft 23. Engagement roller 28 is used to roll the freshly dispensed tape 27 against a surface 50 to be taped. The tape is threaded between gate 26 and engagement roller 28, the gate being openable to facilitate the threading.

Blade 32 is affixed to connection plate 21 within frame 14 utilizing, by way of example, a pair of screws 34. A plastic wiper shield 36 is also affixed to connection plate 21, above blade 32 by screws 34.

A guard 38 formed from a pliable material is affixed to connection plate 21 above blade 32 by screws 34 such that blade 32 is disposed between guard 38 and connection plate 21. Guard 38 extends away from shield 36 from frame 14 for an extent beyond serrated teeth 33 of blade 32. In other words, guard 38 is longer than blade 32 when measured from screws 34. In one embodiment, a distal end, that end extending from frame 14, is slightly bent in the direction generally towards engagement roller 28 to cover serrated teeth of blade 32. By extending past blade 32, guard 38 prevents the serrated teeth from banging against any hard surface and/or coming in contact with a user. Guard 38 can also be formed from non-pliable or even pliable material which is scored along a bendline to form a resilient hinge. This would control the position and degree of bending for guard 38.

Figure 3:
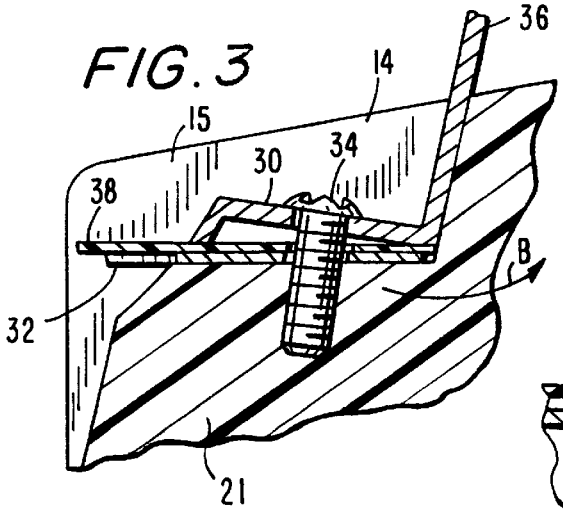
FIG. 3 is a sectional view taken along line 3—3 of FIG. 2.
Figure 4:
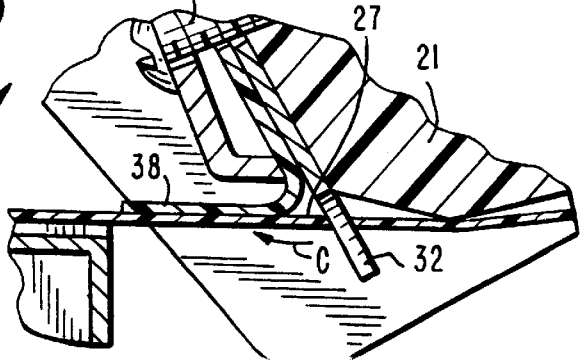
FIG. 4 is the sectional view of FIG. 3 with the applicator rotated.
Figure 5:
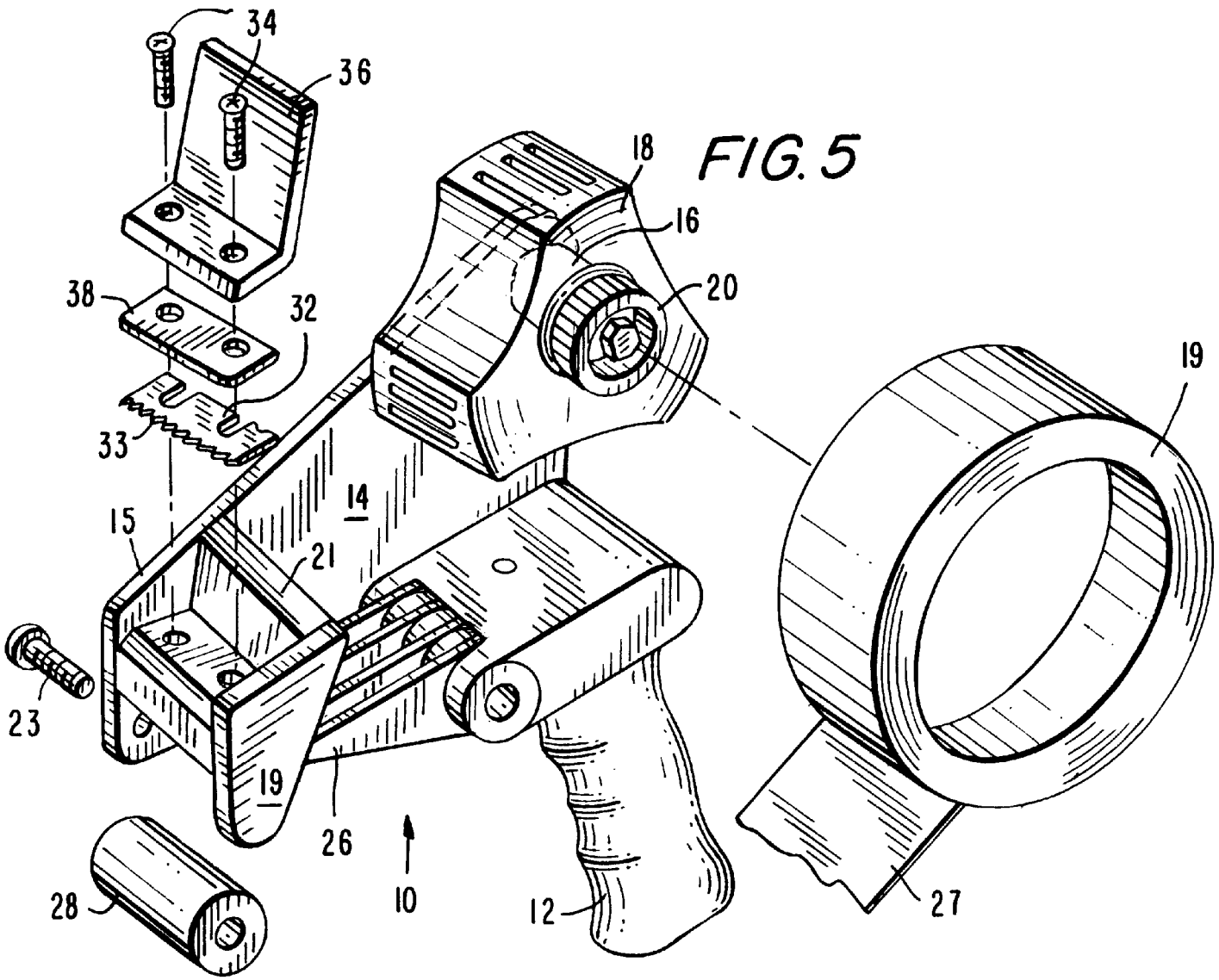
FIG. 5 is an exploded view of the tape applicator constructed in accordance with the invention.

Reference is now also made to FIGS. 3 and 4 in which operation of the hand-held tape applicator 10 is shown. Tape 27 is threaded along a draw path from roll 19 between gate 22 and engagement roller 28 against engagement roller 28. Gate 22 pushes tape 27 against engagement roller 28 to maintain the tape against engagement roller 28. Engagement roller 28 is placed against a surface 50 so that the tacky side of tape 27 comes in contact with surface 50. Engagement roller 28 is then rolled against surface 50 to press tape 27 against surface 50 and draw tape 27 along a draw path, from roller 19 to guard 38, as tape applicator 20 is moved along a path as handle 12 is pulled in the direction of arrow A.

By rotating applicator 10 in the direction of arrow B (FIG. 3), the distal end of shield 38 is brought into contact with tape 27 in the draw path or surface 50 (FIG. 4) and is deflected in the direction of arrow C exposing serrated teeth 32. At a point intermediate the position shown in FIG. 3 and the position shown in FIG. 4, handle 12 can either be moved further in direction of arrow A in which case guard 38 acts as a wiper further pressing the tape 27 against surface 50 to ensure better contact, or handle 12 can be rotated in the direction of arrow B with a slight motion to bring blade 32 into contact with tape 27 to cut the tape. Note, that a motion is not required to bring the tape all the way into contact with shield 36 in order to perform cutting.

When cutting is done, because of the memory of the pliable flexible material, the guard will return to its original position in a direction opposite that to arrow c to cover blade 32.

In the preferred embodiment, guard 38 is made from a clear flexible plastic. Warnings, advertisement, or other text may be provided on the guard. Furthermore, spacers can be added to increase the distance between the blade and the guard to meet applications as needed. Additionally, utilizing a flexible member which is attached to the frame by the already existing blade attaching structure, such as screws, rivets or the like, the guard can be added to existing tape applicators without any need for a modification of the tape applicator.

Figure 6:
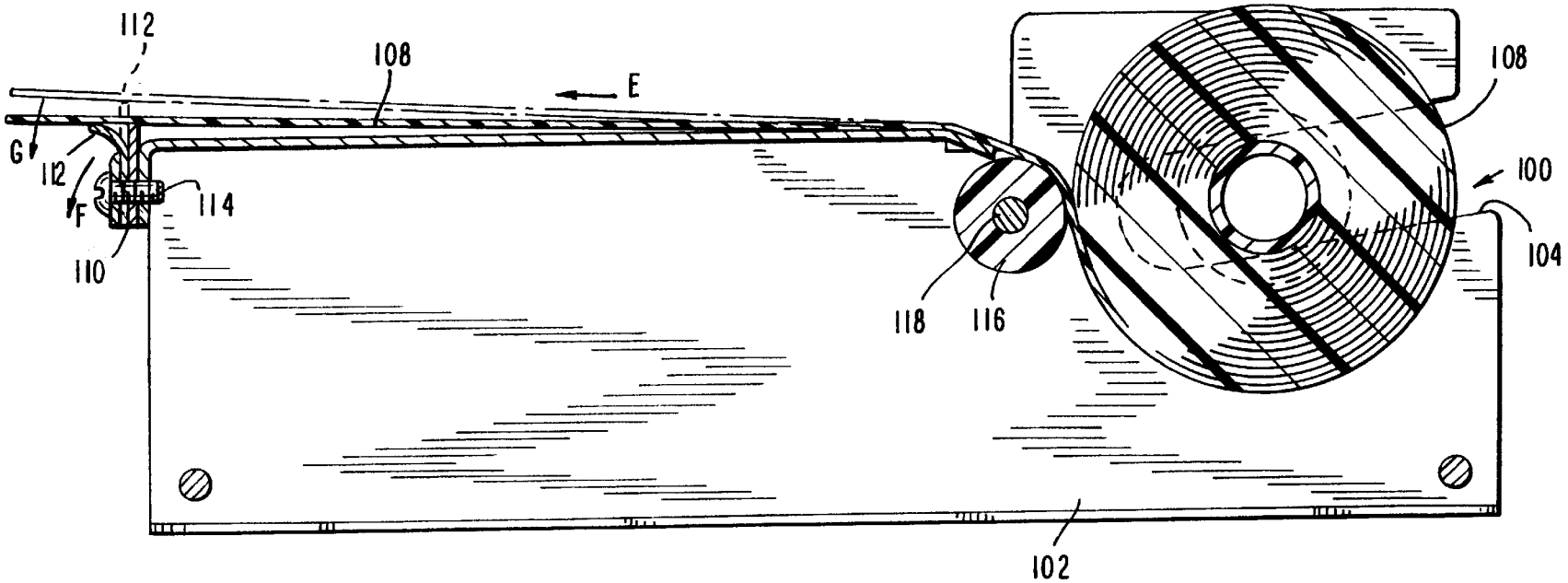
FIG. 6 is a side elevational view of a tape applicator constructed in accordance with a second embodiment of the invention.

Reference is now made to FIG. 6 wherein an applicator, generally indicated as 100, constructed in accordance with a second embodiment for use as a table top tape applicator is shown. Tape applicator 100 includes a frame 102 having a slot 104 formed at a first end of frame 102. A shaft 106 rotatably supports a roll of tape 108 thereon within slot 104. A blade 110 is affixed to a second end of frame 102 so as to extend beyond frame 102 along a tape draw path. A guard 112 formed from a pliable material is connected to frame 102 adjacent blade 112 to extend beyond blade 110 into the tape draw path so that blade 110 is disposed between frame 102 and guard 112. In other words, guard 112 is longer than blade 110 when measured from a screw 114 which affixes both blade 110 and guard 112 to frame 102. Similar to guard 38, by extending past blade 110, guard 112 prevents the serrated teeth of blade 110 from coming in contact with a user. Guard 112 can also be formed from a non-pliable or even non-pliable material which is scored along a bend line to form a resilient hinge. This would control the position and degree of bending for guard 112.

A roller 116 is rotatably mounted on the shaft 118 within frame 102. The roll of tape 108 which forms the tape supply abuts against roller 116 to facilitate tape 108 being peeled from the roll. As the tape mounted about shaft 106 is removed from shaft 106, the roll decreases in diameter. Slot 104 is angled towards a bottom of frame 102 so that as tape is removed from shaft 106 and the diameter decreases, shaft 106 slides along slot 104 to maintain tape 108 in contact with roller 116.

During operation, tape 108 is drawn from shaft 106 across roller 116 in the direction of arrow E. Tape is drawn to the extended length and then pulled down in the direction of arrow G to deflect the guard in the direction of arrow F. As it is drawn beyond frame 102, tape 108 contacts guard 112 and deflects guard 112 in the direction of arrow F to expose blade 110 for cutting a desired length of tape. Once tape has been cut, then the only tape remaining on tape applicator 100 does not extend beyond blade 110 so that there is no longer a force acting on guard 112 allowing guard 112 to return to its original position as shown in phantom in FIG. 6.

By providing a simple construction consisting of a flexible member attached to the frame at the blade, and extending beyond the blade, a universal guard which can be used on conventional tape applicators is provided. Furthermore, by merely affixing the guard to the existing structure which affixes the blade to the frame, the structure is simple, facilitating manufacture and reducing costs by reducing the number of parts in the applicator. Furthermore, in the hand-held version, because of the flexing action of the blade as it comes into contact with the surface, a second wiper for the tape is provided. Additionally, because exposure of the blade is not wiper activated, pieces of tape can easily be torn from the applicator by hand as needed.

Although the above example was given with the guard being made of some flexible material such as plastic and affixed to the blade, it should be noted that the length of the guard extending over the blade can be varied to fit the application. Furthermore, the guard can be made from a variety of materials such as spring steel, a variety of plastics, vinyls, or the like and the design or shape of the device can easily be changed to match the toughness of the material to be cut and the strength of the adhesive to be used which determines the difficulty of the material unwinding from the roller.

It will thus be seen that the objects set forth above, among those made apparent from the preceding description, are efficiently obtained and, because certain changes may be made in carrying out the above construction without departing from the spirit and scope of the invention, it is intended that all matter contained in the above description and as shown in the accompanying drawings shall be interpreted as illustrative and not in a limiting sense.

It is also to be understood that the following claims are intended to cover all of the generic and specific structures of the invention herein described and all statements of the scope of the invention which, as a matter of language, might be said to fall there between.

What is claimed is:

1. A tape applicator comprising:

a frame;

a blade having a cutting edge mounted on the frame and extending therefrom;

a blade having a cutting edge mounted on the frame and extending said frame beyond said cutting edge of said blade;

a tape support adapted to support a supply of tape, said guard being constructed and arranged to resiliently deflect away from said cutting edge of said blade by tape draw into contact with said cutting edge of said blade.

2. The tape applicator of claim 1, further comprising a handle, said frame being supported by the handle.

3. The tape applicator of claim 1, wherein said guard is formed of a pliable material.

4. The tape applicator of claim 1, wherein the guard is made out of plastic.

5. A tape applicator comprising:

a handle;

a frame mounted on the handle;

a blade affixed to the frame and extending therefrom;

a removable guard having a cutting edge, formed from a pliable material, mounted on said frame and extending from said frame beyond said cutting edge of said blade, said guard being constructed and arranged with respect to said blade to be resiliently deflected away from said cutting edge of said blade when tape is drawn into contact with said blade; and a tape roll support adapted to support a supply of tape, mounted on said frame.

6. The tape applicator of claim 5, wherein said guard is made of plastic.

7. The tape applicator of claim 5, wherein said guard is made of spring metal.

8. The tape applicator of claim 5, further comprising a connection plate mounted within the frame, said guard being affixed to said connecting plate, and said blade being affixed to said connection plate.

9. The tape applicator of claim 5, wherein said guard and said fame are formed as a unitary construction.

10. The tape applicator of claim 5, wherein a distal end of said guard extends towards said handle.

11. The tape applicator of claim 1, wherein a distal end of said guard extends substantially perpendicular to said cutting edge of said blade.

12. The tape applicator of claim 1, wherein said frame is constructed so as to rest on a flat surface during use.

13. The tape applicator of claim 1, wherein said guard is mounted on said blade.

14. The tape applicator of claim 1, wherein said guard comprises a resilient hinge.

15. The tape applicator of claim 14, wherein resilient hinge comprises a bendline extending substantially across said guard.

16. The tape applicator of claim 14, wherein said guard is formed of a non-pliable material.

17. The tape applicator of claim 1, wherein said guard is constructed and arranged to deflect so as to expose said cutting edge of said blade and resiliently return substantially to its original position once said tape is no longer in contact with said cutting edge.

18. The tape applicator of claim 1, wherein said guard is mounted on said frame so as to be substantially parallel to said blade.

19. The tape applicator of claim 1, wherein said cutting edge comprises serrated teeth extending in a first direction from a base portion of the blade and said guard extends substantially parallel to said first direction.

20. The guard of claim 19, wherein said guard is formed of a pliable material.

21. A tape applicator comprising:

a frame;

a blade affixed to the frame and extending therefrom;

a guard comprising a resilient hinge mounted on said frame and extending from said frame beyond said cutting edge of said blade;

a tape support adapted to support a supply of tape, said guard being constructed and arranged to resiliently deflect away from said cutting edge of said blade by tape draw into contact with said cutting edge of said blade.

22. A tape applicator comprising:

a frame;

a blade having a cutting edge mounted on the frame and extending therefrom;

a guard comprising a resilient hinge mounted on said frame and extending from said frame beyond said cutting edge of said blade, said resilient hinge comprising a bendline extending substantially across said guard;

a tape support adapted to support a supply of tape, said guard being constructed and arranged to resiliently deflect away from said cutting edge of said blade by tape draw into contact with said cutting edge of said blade.

23. A tape applicator comprising:

a frame;

a blade having a cutting edge mounted on the frame and extending therefrom;

a non-pliable guard comprising a resilient hinge mounted on said frame and extending from said frame beyond said cutting edge of said blade;

a tape support adapted to support a supply of tape, said guard being constructed and arranged to resiliently deflect away from said cutting edge of said blade by tape draw into contact with said cutting edge of said blade.

24. The tape applicator of claim 1, wherein said guard is removably a affixed to said blade.

25. The tape applicator of claim 5, wherein said guard is removably a affixed to said blade.

26. The tape applicator of claim 21, wherein said guard is removably a affixed to said blade.

27. The tape applicator of claim 22, wherein said guard is removably affixed to said blade.

28. The tape applicator of claim 23, wherein said guard is removably affixed to said blade.

* * * * *

UNITED STATES PATENT AND TRADEMARK OFFICE

CERTIFICATE OF CORRECTION

PATENT NO. : 6,296,033 B1
DATED : October 2, 2001
INVENTOR(S) : Alan Clements

It is certified that error appears in the above-identified patent and that said Letters Patent is hereby corrected as shown below:

Column 5,
Line 34, change the words “blade having a cutting edge” to -- removable guard --, and change “the” to -- said --;
Line 35, after the word “extending” insert the word -- from --; and Column 6,
Line 37, change the words “affixed to the” to -- having a cutting edge mounted on the --.

Signed and Sealed this

Eighth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,296,033 B1
DATED : October 2, 2001
INVENTOR(S) : Alan Clements

It is certified that error appears in the above-identified patent and that said Letters Patent is hereby corrected as shown below:

Column 5,
Line 34, change the words “blade having a cutting edge” to -- removable guard --, and change “the” to -- said --;
Line 35, after the word “extending” insert the word -- from --; and Column 6,
Line 37, change the words “affixed to the” to -- having a cutting edge mounted on the --.

Signed and Sealed this

Fifteenth Day of April, 2003

JAMES E. ROGAN
*Director of the United States Patent and Trademark Office*